United States Patent [19]

Pohlman et al.

[11] 4,166,347

[45] Sep. 4, 1979

[54] COMPOSITE STRUCTURAL MEMBER AND METHOD OF CONSTRUCTING SAME

[76] Inventors: Joe C. Pohlman, P.O. Box 15098, Pittsburgh, Pa. 15237; James P. Romualdi, 5737 Wilkins Ave., Pittsburgh, Pa. 15213

[21] Appl. No.: 898,702

[22] Filed: Apr. 24, 1978

Related U.S. Application Data

[63] Continuation-in-part of Ser. No. 733,094, Oct. 18, 1976, abandoned.

[51] Int. Cl.[2] ..... E04C 3/10; E04C 3/34

[52] U.S. Cl. ..... 52/223 R; 52/40; 52/301; 52/687; 52/725

[58] Field of Search ..... 52/725, 223 R, 40, 301, 52/687

[56] References Cited

U.S. PATENT DOCUMENTS

| | | | |
|---|---|---|---|
| 998,839 | 7/1911 | Carleton | 52/301 X |
| 1,932,671 | 10/1933 | Pfistershammer | 52/301 X |
| 3,034,537 | 5/1962 | Seaman et al. | 52/224 X |
| 3,501,881 | 3/1970 | Van Buren | 52/223 R |
| 3,795,949 | 3/1974 | Shorter | 52/223 R |
| 3,810,337 | 5/1974 | Pollard | 52/223 R |

*Primary Examiner*—Alfred C. Perham

[57] ABSTRACT

A composite structural member such as an electric transmission or distribution pole, having a thin-walled metal casing, a core of non-metallic settable rigid material such as concrete, and reinforcing members embedded in the core, and method of constructing the structural member are disclosed. The reinforcing members extend between the ends of the casing and communicate with the case. They are pre-stressed prior to the pouring of the concrete into the casing whereby the applied pre-stress is transmitted to the casing. The reinforcing members are secured to the casing such that the applied pre-stress remains permanently on the casing only. The method of forming the structural member includes securing one of the ends of the reinforcing members to one end of this casing and applying a predetermined stress to the reinforcing members, securing the other ends of the reinforcing members to the other end of the casing, pouring concrete into the casing, and allowing the concrete to set whereby the stress transmitted to the casing remains permanently on the casing only and is not transmitted to the core.

11 Claims, 6 Drawing Figures

A COMPRESSION
B TENSION

COMPOSITE STRUCTURAL MEMBER AND METHOD OF CONSTRUCTING SAME

CROSS-REFERENCE TO RELATED APPLICATION

This application is a continuation-in-part of our earlier application, Ser. No. 733,094, filed Oct. 18, 1976 now abandoned.

BACKGROUND OF THE INVENTION

This invention relates to composite structural members and particularly to electric transmission or distribution poles, and to a method of constructing such members. Electric transmission and distribution poles currently being used are, for the most part, either solid wood, hollow steel tubes or concrete, the latter being either hollow or solid. Concrete poles are further classified as being either conventionally reinforced, pre-stressed, post stressed, or partially pre-stressed. The cross-sections of the poles are either rectangular or circular. For the most part the poles are continuously tapered or, in the case of hollow metal poles, lengths of telescoping tubes of successively smaller diameter achieve cross-sectional reduction in discrete steps.

All of the conventional used poles have inherent drawbacks. Wood poles are subjected to attack by rot-producing fungi, wood-boring insects, woodpeckers, fires, and the like. Steel poles, likewise, have a number of distinct limitations. The steel poles used are generally thick-walled, heavy, and expensive since the use of weight-saving thin walled tubes of high strength steel cannot be fully realized because of the thickness limitations imposed by local buckling considerations. In addition, the interior of steel poles is inaccessible resulting in a danger of undetected corrosion. Galvanizing of the poles is often used, but it has been difficult to achieve good quality control of the interior of the poles and as a result the danger of corrosion persists. Also, steel poles are often formed from sections which are welded together and it is necessary for the welded section to develop the full tensile strength of the adjacent metal. However, quality welds are difficult to achieve and brittle fractures originating at flaws in the welds are also an ever present danger. The thickness limitation imposed by local buckling considerations also aggravates the welding difficulty by requiring welding of thick sections. Because steel poles require special manufacturing facilities, they must be fully assembled at relatively few central facilities and thus require shipping over long distances, adding significantly to the cost of the pole.

Concrete poles are also fraught with disadvantages. Conventional steel reinforced concrete poles must be designed for a bending moment substantially less than the ultimate bending moment of the pole cross-section because the concrete on the tension side will crack at relatively low tensile stresses. These cracks will admit water which, particularly in a marine environment, could cause corrosion of the steel reinforcement members. In addition, conventional steel reinforced concrete poles, because of their low design strength, are usually heavy and uneconomical to use.

Pre-stressed or post-stressed concrete poles may avoid the cracking problems of conventional steel reinforced concrete poles because the cable tensioning will close any cracks after the overload on the pole is removed. However, if overloading and crack opening is repeated too often, particles of matter may become embedded in the cracks to keep them open. Should that happen, the corrosion of the steel members may result from water entering the opened cracks.

Pre-stressed and post-stressed concrete poles are usually tapered to a smaller upper cross-section. Because the number of cables or tendons is constant along the full length of the pole, the pre- or post-stress at the lower section is less than at the top. Therefore, if the lower section of the pole is stressed the desired amount, the upper section would be overstressed. On the other hand, if the upper section is stressed the desired amount, the lower section would be under-stressed. The additional strength required at the lower section could be provided by adding conventional reinforcing steel. However, that practice could add considerably to the cost of the pole. Thus, because of the pole taper, the stressing is unbalanced between the upper and lower sections resulting in a loss of economy of the poles.

Although concrete poles require less specialized equipment for their manufacture than metal poles, the forms used are cumbersome and costly, especially where the poles are formed by centrifugal casting. Thus, a large capital expenditure is required in the forms used for producing concrete poles in order to provide a profitable production rate. In addition to the costly forms, special steam curing equipment is often required to reduce the time the forms are in use for each pole made.

There are various other disadvantages of conventional steel, wood, steel reinforced, concrete, pre-stressed concrete and post-stressed concrete poles as those skilled in this art are well aware of. The present invention overcomes most of the disadvantages enumerated above as well as those not enumerated. This invention in its various embodiments includes thin-walled metal shells and cores of non-metallic settable rigid material such as concrete embedding pre-stressed steel cables or tendons. The ability to use thin-walled casings results in cost savings in material, fabrication and shipping costs. In addition the thin-walled casing eliminate the need for special forms and rapid curing techniques. Also, the shell serves to protect the concrete core by covering the cracks which would result during overstressing of the pole while at the same time the concrete core serves to protect the interior of the steel casing from corrosion, thereby eliminating the need for costly galvanizing of the casing. The structural members of this invention also reduce the danger of weld failure as well as allowing simple inclusion of additional lower section tendons to provide balanced pre-stressed structural members. Also, the structural members of this invention may be formed in a relatively simple fabrication facility set up near the use area thereby reducing capital requirements and shipping costs as compared with the same costs of a complex factory of the nature required for forming conventionally used poles, for example. Various other advantages of this invention will be expressed at a later place in this specification.

SUMMARY OF THE INVENTION

The present invention provides a novel composite structural member, such as an electrical transmission or distribution pole, and a novel method for constructing the structural member. The composite structural member of this invention in its preferred form includes an elongated outer metal casing; a body of non-metallic settable material such as concrete, encased by and extending between the ends of the casing; a plurality of elongated reinforcing members embedded within the body of settable material and extending between the ends of the casing and communicating with the casing, each reinforcing member being under a predetermined magnitude of applied stress and being arranged to transmit the applied pre-stress only to the casing; securing means supported by the casing for securing the reinforcing members to the casing such that the applied prestress remains permanently on the casing only.

The preferred method of constructing a composite structural member of the present invention includes the steps of securing one of the ends of each reinforcing member to the securing means and disposing the other ends of the reinforcing members loosely within the other securing means; applying a predetermined stress to the reinforcing members by pulling them in a direction opposite to the originally secured ends, whereby the stress applied to the reinforcing members is transmitted to the casing; securing the other ends of the reinforcing members in the other securing means; pouring a fluid non-metallic settable material such as concrete into the casing to embed the reinforcing members; and allowing the fluid material to set whereby the stress transmitted by the reinforcing members to the casing remains permanently on the casing only and is not transmitted to the body of set material.

Various other advantages, details and modifications of the present invention will become apparent as the following descriptions of a present preferred embodiment and present preferred method of constructing the embodiment proceed.

BRIEF DESCRIPTION OF THE DRAWINGS

In the accompanying drawings we show a composite structural member which illustrates a present preferred embodiment of this invention in which.

Figures 1, 2, 3, 4, 5, 6:
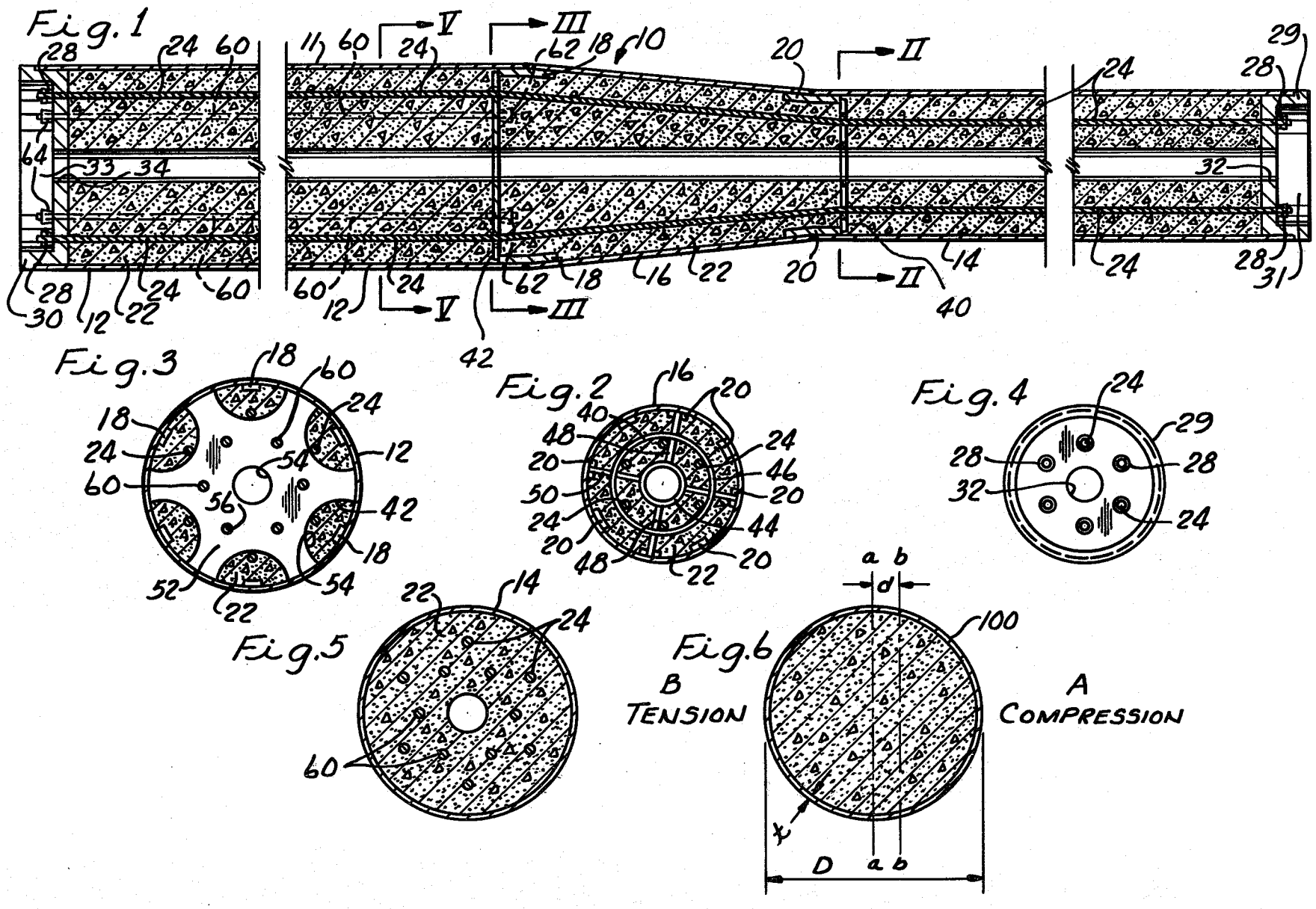
FIG. 1 is an elevation view in cross-section of an electric transmission or distribution pole embodying the composite structural member of the present invention.
FIG. 2 is a cross-sectional view taken along the line II—II of FIG. 1.
FIG. 3 is a cross-sectional view taken along the line III—III of FIG. 1.
FIG. 4 is a plan view of the end cap.
FIG. 5 is a cross-sectional view taken along the line V—V of FIG. 1.
FIG. 6 is a diagrammatic cross-sectional view of a concrete filled casing which does not represent this invention, but is merely to aid in an explanation of the reason of the advantages of the embodiment of this invention.

Referring now to the drawings there is shown a composite structural member of the present invention in the form of an elongated electric transmission or distribution pole 10, which includes casing 11 formed of a lower casing 12 of circular cross-section and an upper casing 14 also of a circular cross-section but having an outer diameter of a smaller size than that of the lower casing. Although only two sections of casing 12 and 14 are shown, more may be used. The respective lower and upper casings 12 and 14 are formed from relatively thin steel, which could be on the order of $\frac{1}{8}$ to $\frac{1}{4}$ inch thick or less but could be thicker with larger diameter casings, as those skilled in this art would readily understand. The lower and upper casings 12 and 14 are joined by a transition section 16 which is suitably welded respectively to the upper end of lower casing 12 and the lower end of upper casing 14. To insure proper alignment of the lower casing 12 to the transition piece 16, a plurality of alignment clips 18 formed of flat sections of steel bent at intermediate points to an angle generally conforming to that of the transition piece 16 are secured as by welding to the lower end region of the transition piece. Similarly, alignment clips 20 of the same general configuration of clips 18 are secured to the upper end portion of transition piece 16. Other alignment means of various designs could be substituted for the clips 18 and 20 as those skilled in this art would readily appreciate.

The pole 10 also includes a core 22 of rigid non-metallic settable material, such as a non-shrinking conventional or steel-fiber reinforced concrete, plastic foam, or the like. The type of material used to form core 22 would generally have the strength and stiffness characteristics comparable to concrete. For sake of ease of description, the material of core 22 will be referred to as being concrete with the understanding that the invention is not limited to concrete. The core of concrete 22 extends between the ends of the entire pole and embeds a plurality of reinforcing members in the form of steel cables 24 arcuately spaced from each other in a circular pattern all being radially equidistant from the respective lower and upper casing 12 and 14. The upper and lower ends of the cables 24 are secured by clamps 28 of well-known design to upper end cap 29 and lower end cap 30 which respectively fit snugly into and are secured to the upper end of upper casing 14 and lower end of lower casing 12. Upper cap 29 has a recessed center section 31 which is provided with a series of openings sized for receiving the ends of the cables 24, and a larger opening 32 which serves to permit fluid concrete to be poured into the pole 10. Lower end cap 30 also has a recessed center section 33, a large center opening 34 for receiving a mandrel which allows a hollow core concrete body to be formed, and two series of concentrically arranged openings for receiving the lower ends of cables 24 and the lower ends of other cables to be described later.

As will be more fully described hereinafter, the cables 24, as shown, are pre-stressed prior to pouring the concrete. It is advantageous from a stress standpoint to have the cables 24 close to the casings. Since lower casing 12 has a greater diameter than upper casing 14 the cables 24 must change direction between the casings in order to maintain an equidistant spacing to the respective upper and lower casings. Otherwise, the spacing would be greater between the cables 24 and lower casing 12 than between cables 24 and upper casing 14. If the spacing disparity were allowed to exist, the desired increase in strength of the pole 10 at the lower section would not be achieved. In order to provide the equidistant spacing between the cables 24 and lower casing 12, transition piece 16, and upper casing 14, guides 40 and 42, as clearly shown in FIGS. 2 and 3, are provided. Guide 40 includes an annular central section 44 arranged to be coaxial with the axis of upper casing 14, and an annular guide section 46 coaxial with the central section and secured thereto with four ribs 48 spaced 90 degrees apart and welded to the respective sections 44 and 46. Four equally arcuately spaced support ribs 50 are secured by welding to the outer surface of the guide section 46 and extend radially to fit onto the upper surface of four equally spaced alignment clips 20 to which they are secured as by welding. The inner diameter of the guide section 46 will be selected as desired to provide the desired spacing between the cables 24 and upper section 14. Guide 42, as shown clearly in FIG. 3, includes a flat plate 52 having a generally disc shape with an outer diameter slightly less than the inner diameter of lower casing 12. Equally arcuately spaced scallop sections 54 are cut out of the plate 52 and are sized and shaped to receive the cables 24 and support them at the same distance from the lower casing 12 as they would be from the upper casing 14. The guide 42 is secured to the lower ends of alignment clips 18 by welding thereto. Guide 42 is also provided with a central opening 54 and a series of smaller openings 56 arranged in a circular pattern as shown. Opening 54 is coaxial with the axis of lower casing 12 and thus also with upper casing 14 and annular section 44 of guide 40, and it serves with the annular section 44 to receive a mandrel when a hollow core concrete body is cast within the casings. The openings 56 serve to receive the ends of cables 60 which are embedded in the lower portion of the concrete body 22 to provide additional strength to the lower section of the pole 10, as will be more fully elaborated upon later on in this description. The upper ends of the cables 60 are secured by clamps 62 to the guide 42 while the lower ends of the cables are secured by clamps 64 to the lower end cap 30.

In forming pole 10, the upper end cap 29 is placed in position to be mated to the upper end of upper casing 14. The guide 40 is welded into fixed orientation with the lower section of upper casing 14. The cables 24 are fixed at their upper ends to the upper end cap 29. The transition piece 16 is fitted over the alignment clips 20, and then the lower guide 42 is secured to the alignment clips 18 of the lower casing 12. The cables 24 are moved through the upper casing 14 and within the confines of the guide section 46 of the guide 40, and then through the transition piece 16. At this point the cables 60 are placed within the lower casing 12 and their upper ends clamped in place on the guide 42. The cables 24 are now directed through the scallop sections 54 of guide 42 and out the lower end of the lower casing 12. The lower ends of the cables 24 and 60 are guided through the openings provided for them in the lower end cap 30. The upper and lower end caps 29 and 30 are fitted into place and a few of the cables 24 lightly tensioned to draw the upper end cap 29, upper casing 14, transition piece 16, lower casing 12, and lower end cap 30 together, and all the components are then secured in place by welding. The next step would be to pre-stress the cables 24 and 60 to a predetermined magnitude and then the cables are secured in place in the lower end cap 30 such that the applied pre-stress remains permanently on the casing 12. A metal mandrel is then positioned within the casing 12 and 14 by inserting it through opening 34 of the lower end cap 30. The mandrel used would be generally cylindrically shaped but could be tapered with larger diameter poles. The mandrel would be centrally positioned within the upper and lower casings since it would be inserted into the openings of central section 44 of guide 40 and the opening 54 of guide 42. Concrete would now be poured into the casings by pumping it through the opening 32 of the upper end cap 29. Suitably arranged openings through the wall of the casing could also be provided through which concrete could be poured. it is to be noted that the mandrel may be eliminated and a hollow body of concrete formed by pouring concrete into the casings and rotating the entire pole about its longitudinal axis. Regardless of how the concrete is handled, when it sets it is not under any applied stress and remains that way for the life of the pole. The mandrel, if used, is removed and the recessed portions of the respective end caps 29 and 30 filled with a suitable sealing material.

By pre-stressing the cables 24 and 60 prior to pouring of the concrete a composite structural member of superior bending stress and stiffness is realized than has been heretofore found. This will be best understood by those skilled in this art after reading the following mathematical explanation of the interaction of the elements.

FIG. 6 is a diagrammatic sketch of the cross-section of a concrete filled steel casing 100 with diameter D and thickness t. The shell is filled with concrete and the section subjected to a bending moment such that side A of the shell is in compression and side B in tension. The line a—a is the diametric center of the casing. The portion of the concrete in the tension region, however, is considered cracked and, therefore, the neutral axis of the composite section shifts toward the compression side to line b—b by an amount d. The result of this shift is that the distance from the neutral axis b—b to the farthermost compression fiber is $D/2-d$ and the distance to the farthermost tension fiber is $D/2+d$. Thus, the concrete will reach its yield stress in tension at a steel casing bending moment less than that required to cause yield of a hollow steel casing of the same dimension without a concrete core wherein the neutral axis is along line a—a.

To better illustrate this situation, and to further illustrate the advantages of this invention, a sample calculation is provided. Assume a steel casing 100 with an outside diameter, D, of 36 inches, a wall thickness, t, of 0.25 inches, and a yield strength of 65,000 pounds per square inch (psi). Conventional calculations of well-known engineering mechanics will show the moment of inertia about the axis a—a to be $$I_{a-a}=4485.9 \text{ in.}^4$$

From the well-known beam bending equation, the moment resisted by the cross-section at the steel yield stress of 65000 psi is $$M_1=(65000\ (4485.9)/18=16{,}199{,}083 \text{ inch-pounds}$$

where, in the above equation, the number 18 in the denominator is the distance from the neutral axis (a—a) to the extreme fiber (tension and compression being the same in this case). However, if, for example, the neutral axis shifted toward the compression side to line b—b by an amount $d=4$ inches due to the presence of concrete that is partially cracked, the moment of inertia of the steel casing will increase (from the well-known expression $I_{b-b}=I_{a-a}+Ad^2$ where A is the cross-sectional area of the steel) to $$I_{b-b}=4485.9+(28.1)\ (4)^2=4935.5 \text{ in.}^4$$

However, the distance to the extreme fiber in tension from the new neutral axis b—b is now $18+4=22$ inches, and the bending moment required to cause the tension side of the beam to reach its yield strength of 65000 psi is now $$M_2=(65{,}000)\ (4935.5)/22=14{,}582{,}159 \text{ inch-pounds}$$

It is noted that the moments $M_1$ and $M_2$ above refer only to the bending moment resistance of the steel casing. In comparing $M_1$ and $M_2$ it is further noted that $M_2$, the bending moment resistance of the steel casing in the presence of a concrete core, is less than that of the same casing without concrete. The embodiment of the invention just described above all obviate this detrimental effect.

The moment $M_2$ described above is that which causes the tension side B of the casing in FIG. 6 to reach 65,000 psi, the yield stress. At the same time, the stress in the compression side A is $$S=(14{,}582{,}159)\ (-14)/4935.5=-41{,}364 \text{ psi}$$

However, if the steel casing is first (before the addition of concrete) uniformly prestressed in compression by an amount of 14,000 psi by means of pre-stressing cables 24 and 60 as described placed within the casing and secured to the casing at the distal ends, the stress in the tension side B after the curing of the encased concrete and the application of the bending moment $M_2$ will be $$S_3=65{,}000-14{,}000 = 51{,}000 \text{ psi}$$

and the stress in the compression side A will be $$S_2= -41{,}364-14{,}000= -55{,}364 \text{ psi}$$

By the introduction of pre-stressing of the casing, the tension side B and compression side A of the casing are not yet stressed to the yield stress of 65,000 psi when the steel casing resists the bending moment $M_2$. If the attainment of yield is the criterion for bending capacity, additional moment, $M_3$, can be added to cause the tension side B to increase 14,000 psi to a total of 51,000+14,000=65,000 psi. Moment $M_3$ is calculated from the beam bending equation to yield $$M_3=(14{,}000)\ (4935.5)/22=3{,}140{,}773 \text{ inch-pounds}$$

The total moment resisted by the steel casing, with the beneficial effects of pre-stressing, is $M_2+M_3$, or 17,722,932 inch-pounds—a value greater than that resisted by the shell in the absence of concrete when the neutral axis is symmetrically located along line a—a in FIG. 6. It is understood that the moment capacity of the composite steel casing, pre-stressed cables and concrete core is greater than $M_3$ because the resistance contributed by the steel area of the pre-stressing cables and the concrete area must be added. However, the addition of the pre-stressing of the steel casing has overcome the problem of yielding of the steel at reduced moment capacity due to the eccentric location of the neutral axis. This problem has not previously been overcome in transmission or distribution pole design and manufacturers and designers have generally avoided filling poles with concrete because of the knowledge that the cracked concrete section will cause a shift in the neutral axis as portrayed in FIG. 6.

It was earlier noted that the diminishing diameter of the structure causes difficulty stressing if the cables are continuous from one end of the casing to the other. The difficulty arises from the fact that, because the total force is constant but the cross-sectional area of the casing varies, the stress in the structure will be different at one end than at the other. The use of guides 42, as also noted, serves as an intermediate anchoring device for additional cables 60 that are incorporated when the pole diameter has been increased. It is necessary to insure that the thickness of the guide 42 is sufficient to transfer the additional pre-stressed cable forces to the wall of the lower casing 12.

Regardless of whether conventional concrete, lightweight concrete or steel-fiber reinforced concrete, plastic foam, or whatever type of non-metallic settable material is used to form core 22, it is to be clearly understood that one of the functions of the enclosed core, in addition to preventing local buckling of the steel casing and adding bending strength and stiffness, is the obviation of corrosion of the inside surface of the steel casing. Thus, it is a requirement that all or any non-metallic settable material used have additives or compositions such that it is either non-shrinking or slightly expansive. If this is not adhered to, the slight shrinking will leave a thin gap between the inside of the steel casing and the core and invite corrosion due to entrapped moisture.

The number of cables 24 and 60 required depends on the desired stress to be placed on the structure. The total stressing force equals the stress in the steel casing times its cross-sectional area. The desired stress of the casing would be known as would the respective moduli of elasticity of the casing. Thus, the total force required by the cables may be simply calculated. The total number of cables required would be determined by dividing the total force by the allowable force for each cable which would also be known.

Some of the advantages of the composite structural member of the present invention were referred to earlier. Some of those advantages will now be elaborated upon and others not previously mentioned will be set forth. As stated earlier the structure of the present invention overcomes the disadvantages stated with respect to wood, metal, and concrete poles.

The wall thicknesses of the metal casings that form the structure's casings are much smaller than those normally associated with conventional hollow metal poles. The wall thicknesses can be on the order of ⅛ to ¼ inch, or less, but there is no limitation posed by buckling. This attribute arises because the metal casing is fixed in radial position by the presence of the concrete core. Although local buckling is not totally obviated, the sensitivity to buckling phenomena is greatly decreased. The cylindrical casing thickness selected will be dictated by the local strength required for attachments such as cross-arms, and strength during handling of the empty casings. The ability to utilize thin-wall casings leads to savings in material, fabrication and shipping costs. The thin-wall pole casing previously described, in addition to providing structural strength to a composite concrete-steel pole, serves as the casting form and thus eliminates the need for special forms and rapid curing techniques. The casings may be assembled at any convenient location that will provide access to a concrete pump and concrete mixing equipment. In addition, the interior of the metal casing is protected against corrosion by the material that is cast against it. Thus, the interior of the metal casing need not be galvanized. Also, the metal casing protects the core by providing a watertight protective covering. Thus, the occurrence of cracking at bending moments close to the ultimate blending moment of the core is not a matter of serious concern. Together with the above advantages, the ability to add pre-tensioning cables at intermediate locations where there is a change in cross-sectional dimensions of the pole is a novel method of pre-tensioning tapered poles in a balanced manner.

In addition to the above advantages of the structure of the present invention other additional advantages are obtained. The separate components can be standardized to permit the assembling of a pole of given geometry and strength from a number of standard cylinders, transition pieces, and pre-tensioning cables. Thus, the fabrication center need not be a complex factory, but could be readily set up near the area where the poles are to be installed, reducing shipping costs and capital requirements. The cylindrical metal casing acts to confine the core. This is an example of synergism inherent in this unique design. Thus, the core protects the inside of the metal casing against corrosion and increases its resistance to buckling, while the metal casing, in turn, seals cracks in the core. Also, the welds that join the sections of the cylindrical casing together are stressed in compression by the pre-tensioning. When the stresses due to bending of the pole are superimposed on these initial compression stresses, the welds remain in compression until the initial compressive stress is totally cancelled. Thus, for a significant portion of the ultimate bending resistance of the pole, no welds are in tension and weld failure is minimized.

It should also be noted that the reinforcing members (i.e. cables 24) need not have a uniform arcuate spacing as described and illustrated. As those skilled in the art would recognize, non-uniform spacing of the cables would be arranged where it is anticipated that the pole would bend in one direction only. In that event the cables would be so arranged that the compressive stress in the casing due to pre-stressing would be higher on the side that would be subjected to live load or dead load tension stresses. In other words the spacing of the cables in the tension side of the pole would be closer than the spacing on the compression side.

While we have shown and described a present preferred embodiment of this invention and have also described a present preferred method of constructing the embodiment, it is to be distinctly understood that the invention is not limited thereto, but may be otherwise variously embodied and constructed within the scope of the following claims.

We claim:

1. A composite structural member comprising:

an elongated outer metal casing;

a body of non-metallic settable rigid material encased by and extending between the ends of said casing;

a plurality of elongated reinforcing members embedded within the said body and extending between the ends of said casing and communicating with said casing, each reinforcing member being under a predetermined magnitude of applied pre-stress and being arranged to transmit the applied pre-stress only to said casing; and securing means supported by said casing for securing said reinforcing members to said casing such that the applied pre-stress remains permanently on said casing only.

2. A composite structural member as set forth in claim 1 wherein said body is hollow over its entire length.

3. A composite structural member as set forth in claim 1 including guide means within and supported by said casing for guiding said reinforcing members between the ends of said casing such that the reinforcing members are all equidistant over their entire length from the inner wall of said casing.

4. A composite structural member as set forth in claim 1 wherein said casing decreases in its transverse outer size between its ends.

5. A composite structural member as set forth in claim 1 wherein said body of settable material is concrete.

6. A composite structural member as set forth in claim 1 wherein said reinforcing members are cables.

7. A composite structural member as set forth in claim 4 wherein at least a first portion of the said casing having greater transverse outer size than the remainder of said casing has more of said reinforcing members therein than does said remainder of said casing.

8. A composite structural member as set forth in claim 7 wherein said first portion and said remainder of said casing are generally frusto-conical in shape; and including a transition piece joining said first portion and said remainder.

9. A composite structural member as set forth in claim 4 wherein said casing comprises a plurality of sections; and including means for joining said sections together.

10. A composite structural member as set forth in claim 9 including alignment means on said sections for providing alignment between respective sections of said casing.

11. A method of constructing a composite structural member comprising an elongated outer metal casing, a core of non-metallic rigid settable material, elongated reinforcing members embedded in the core and extending between the ends of the casing and securing means attached to the casing for securing the end sections of the reinforcing members, said method comprising the steps of securing one of the ends of each of the reinforcing members to the securing means and disposing the other ends of the reinforcing members loosely within the other securing means;

applying a predetermined stress to the reinforcing members by pulling them in a direction opposite to the originally secured ends, whereby the stress applied to the reinforcing members is transmitted to the casing;

securing the other ends of the reinforcing members in the other securing means;

pouring fluid non-metallic settable material into the said casing to embed the reinforcing members; and allowing the material to set, whereby the stress transmitted by said reinforcing members to said casing remains permanently on said casing only and is not transmitted to the body of the set material.

* * * * *